US006450925B1

(12) United States Patent
Kuo

(10) Patent No.: US 6,450,925 B1
(45) Date of Patent: Sep. 17, 2002

(54) EXERCISER HAVING ADJUSTABLE MECHANISM

(76) Inventor: Hai Pin Kuo, No. 15, Lane 833, Wen Hsien Road, Tainai City, 704 (TW)

( * ) Notice: Subject to any disclaimer, the term of this patent is extended or adjusted under 35 U.S.C. 154(b) by 0 days.

(21) Appl. No.: 09/907,831

(22) Filed: Jul. 19, 2001

(51) Int. Cl.[7] ..... A63B 69/16; A63B 22/04
(52) U.S. Cl. ..... 482/52; 482/51
(58) Field of Search ..... 482/51, 52, 53, 482/57, 76, 79, 80

(56) References Cited

U.S. PATENT DOCUMENTS 5,383,829 A 1/1995 Miller ..... 482/57
5,779,599 A 7/1998 Chen ..... 482/57
6,007,462 A * 12/1999 Chen ..... 482/57
6,053,847 A * 4/2000 Stearns et al. ..... 482/51
6,277,054 B1 * 8/2001 Kuo ..... 482/51

* cited by examiner

*Primary Examiner*—Stephen R. Crow
(74) *Attorney, Agent, or Firm*—Charles E. Baxley

(57) ABSTRACT

An exerciser includes a pair of tracks having a rear portion rotatably supported on a base with a pair of cranks, a pair of bars pivotally secured to a front portion of the base, a pair of levers each having a foot support and each having a front portion pivotally secured to the bars and each having a rear end slidably engaged on the tracks, for allowing the foot supports to be moved in a reciprocating action. The tracks are movably supported on the front portion of the base without being elevated, such that the foot supports may be lowered and stably supported on the base.

12 Claims, 6 Drawing Sheets

EXERCISER HAVING ADJUSTABLE MECHANISM

The present invention is related to U.S. patent application Ser. No. 09/617,772, filed Jul. 17, 2000, pending.

BACKGROUND OF THE INVENTION

1. Field of the Invention

The present invention relates to an exerciser, and more particularly to a stepping exerciser having an adjustable mechanism for adjusting the moving stroke or the moving path or the stride of the exerciser, and having a lowered moving path or center of gravity for allowing the stepping exerciser to be stably operated.

2. Description of the Prior Art

U.S. Pat. No. 5,383,829 to Miller discloses a typical exerciser having a pair of foot supports movable along an elliptical moving path or an elliptical stride which may not be adjusted. U.S. Pat. No. 5,779,599 to Chen discloses another typical exerciser having a pair of foot supports movable along an elliptical moving path or en elliptical stride. The elliptical moving path or the elliptical stride of the exerciser may be adjusted by threading and unthreading the fasteners which may not be quickly operated or may not be quickly threaded and unthreaded relative to the elements that are required to be adjusted. In addition, the exercisers should be stopped before the moving stroke or the moving path or the stride of the exercisers may be adjusted.

The present invention has arisen to mitigate and/or obviate the afore-described disadvantages of the conventional exercisers.

SUMMARY OF THE INVENTION

The primary objective of the present invention is to provide a stepping exerciser including an adjustable mechanism for easily and quickly adjusting the moving stroke or the moving path or the stride of the exerciser without stopping the exercisers or while the exerciser is still operated.

The other objective of the present invention is to provide a stepping exerciser including a lowered moving path or a lowered center of gravity for allowing the stepping exerciser to be stably operated.

In accordance with one aspect of the invention, there is provided an exerciser comprising a base including a front portion, and including a rear portion having a pair of cranks provided thereon, a pair of tracks including a rear end rotatably secured to the cranks respectively, and including a front portion slidably supported on the front portion of the base, a pair of bars pivotally secured to the front portion of the base, the bars each including a lower portion and a middle portion, a pair of levers movably supported on the base, and each including a foot support provided thereon, and each including a front portion pivotally secured to the lower portions of the bars, and each including a rear portion slidably engaged on the tracks respectively, for allowing the levers and the foot supports to be moved in a reciprocating action, and means for coupling the bars to the tracks. The tracks are movably supported on the front portion of the base without being elevated, for lowering the foot supports, and for allowing the exerciser to be stably operated by the users.

The front portion of the base includes a pair of pulleys rotatably supported thereon for slidably supporting the front portions of the tracks respectively.

The coupling means includes a pair of links having a rear end pivotally secured to the racks respectively, and having a front portion pivotally coupled to the bars respectively.

A device is further provided for adjusting the front portions of the links relative to the bars respectively in order to adjust the foot supports relative to the bars, and includes two sleeves slidably engaged on the bars respectively, the front portions of the links are pivotally secured to the sleeves respectively with a pivot pole.

The adjusting device includes two slides slidably received in the bars respectively, the front portions of the links are pivotally secured to the slides respectively.

A device is further provided for moving the slides relative to the bars respectively to adjust the links and the foot supports relative to the bars, and includes a motor, and means for connecting the motor to the slide to move the slides relative to the bars respectively.

The moving device further includes a switch provided on top of the bars and coupled to the motor in order to actuate the motor without stopping the exerciser.

The bars each includes a chamber formed therein for slidably receiving the slides respectively, the connecting means includes a pair of bolts rotatably received in the bars respectively and threadedly coupled to the slides respectively, and the motor is coupled to the bolts for rotating the bolts to move and to adjust the slided along the bars respectively.

The slides each includes a tube coupled thereto and threadedly engaged with the bolts respectively, the connecting means includes a pinion attached to each of the motors, a gear attached to each of the bolts and coupled to the pinions respectively for coupling the motors to the bolts respectively.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
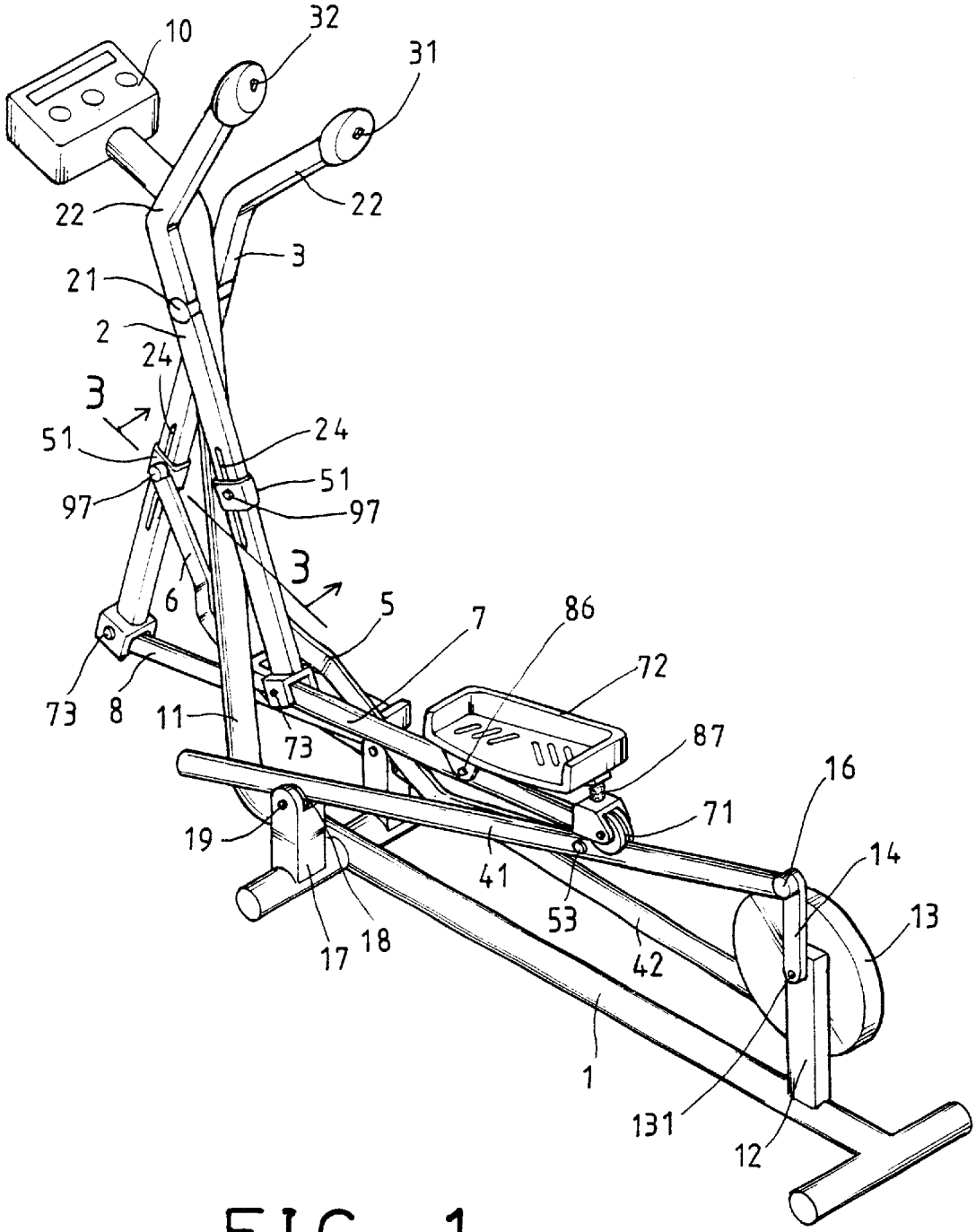
FIG. 1 is a perspective view of an exerciser in accordance with the present invention.
Figure 2:
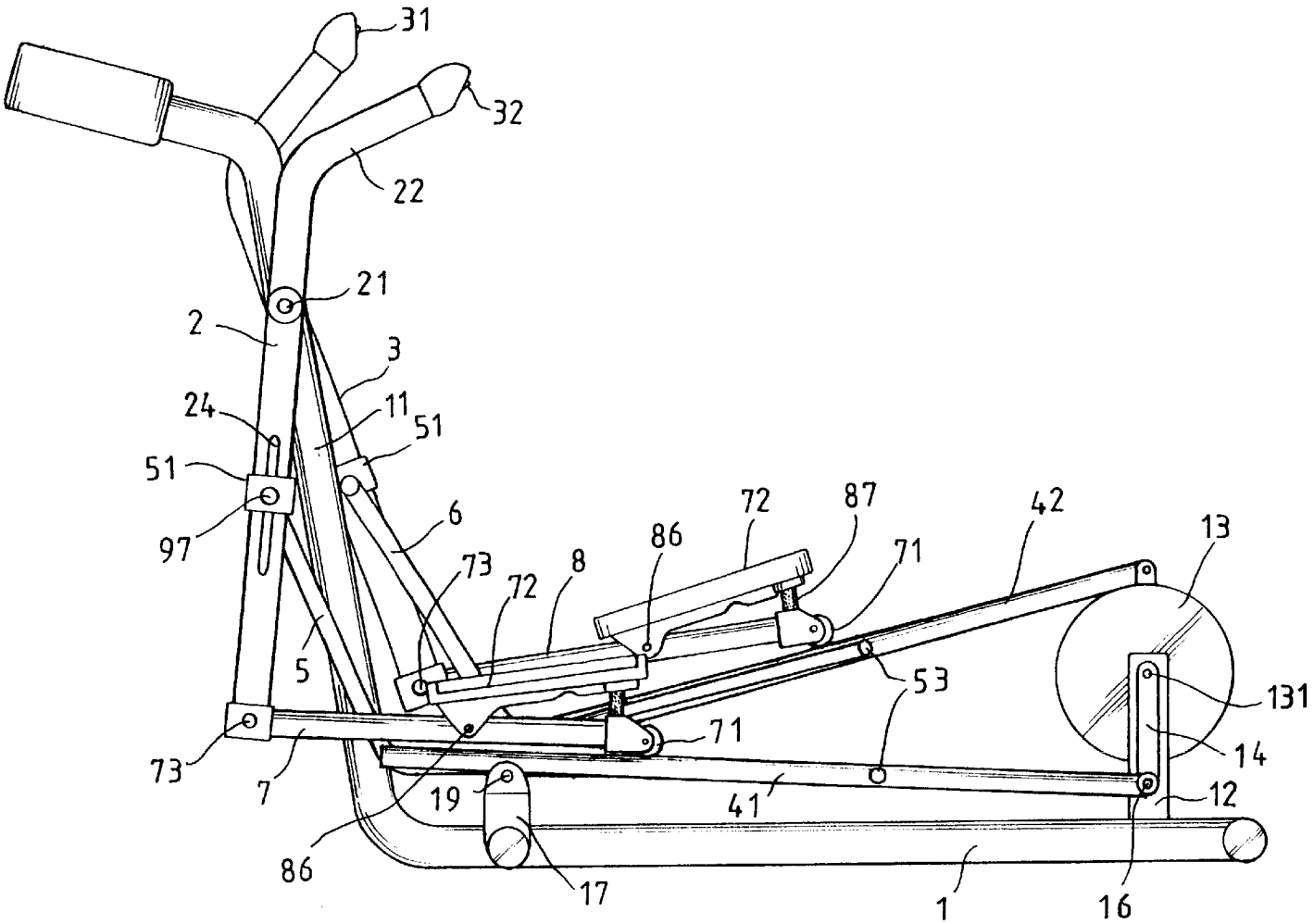
FIG. 2 is a side view of the exerciser.

Referring to the drawings, and initially to FIGS. 1 and 2, an exerciser in accordance with the present invention comprises a base 1 including a post 11 extended upward from or provided on the front portion thereof and including a stay 12 extended upward from or provided on the rear portion thereof. A control box 10 or the like is disposed on top of the post 11 for controlling the operation of the exerciser, for example. A wheel 13 and a pair of cranks 14 are rotatably secured or supported on the stay 12 with a pivot shaft 131 and rotatable about the pivot shaft 131. The cranks 14 are extended away from each other as that for the typical cycling devices, and each includes a free end having an axle 16 attached thereto or provided thereon. The wheel 13 is used for providing a resistive force against the operation of the exerciser. The base I includes a pair of columns 17 extended upward from the front portion thereof and spaced away from each other, and two pulleys 18 rotatably supported on top of the columns 17 respectively with a pivot axle 19.

A pair of bars 2, 3 have a middle or upper portion rotatably or pivotally secured to the upper portion of the post 11 with one or more rods 21, and each includes a handle 22 provided on top thereof, and each includes a chamber 20 (FIG. 3) formed in the inner portion thereof, and each includes one or more slots 24 formed in the middle or lower portion thereof and located or provided below the rod 21. A pair of tracks 41, 42 have a middle portion slidably or movably supported on the respective pulleys 18, and each includes one end pivotally or rotatably secured to the free ends of the cranks 14 at the axles 16 respectively. A pair of levers 7, 8 each has a front end pivotally or rotatably secured to the lower portions of the bars 2, 3 with a pivot pin 73, and each has a roller or a pulley 71 attached to or provided on the rear portion thereof and rotatably or slidably or movably engaged on the respective tracks 41, 42, and each has a foot support 72 provided on the middle portion thereof.

Figure 3:
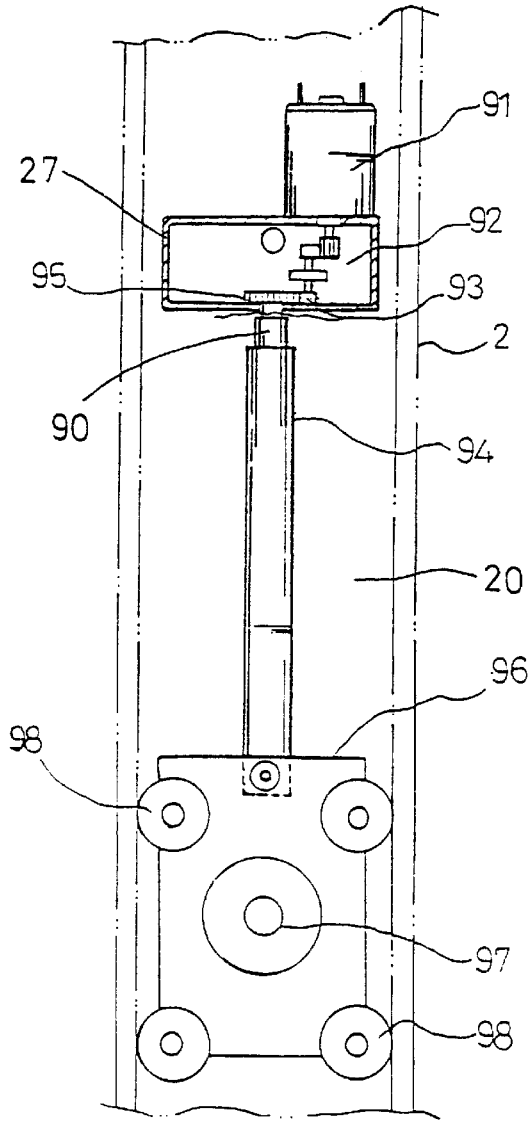
FIG. 3 is a partial cross sectional view taken along lines 3—3 of FIG. 1.
Figure 4:
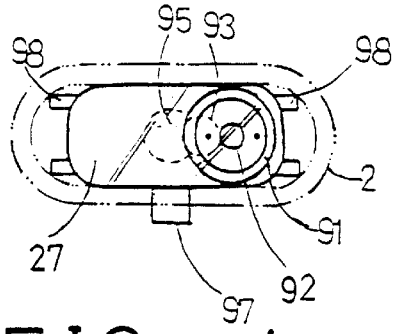
FIG. 4 is an end view of the elements as shown in FIG. 3.
Figure 5:
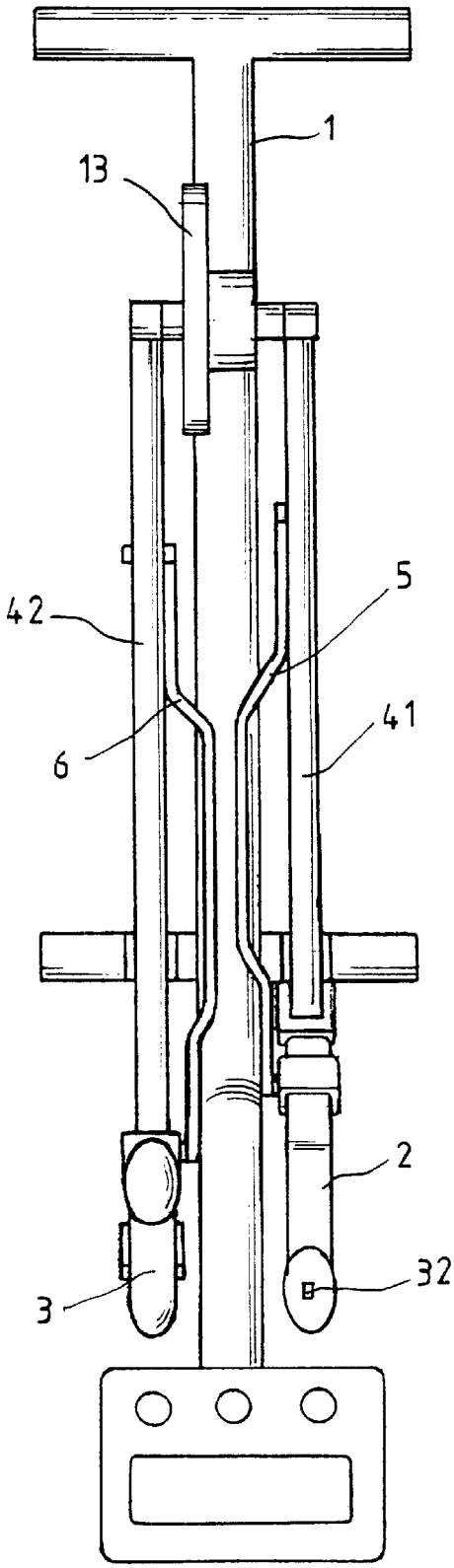
FIG. 5 is a top view of the exerciser.
Figure 6:
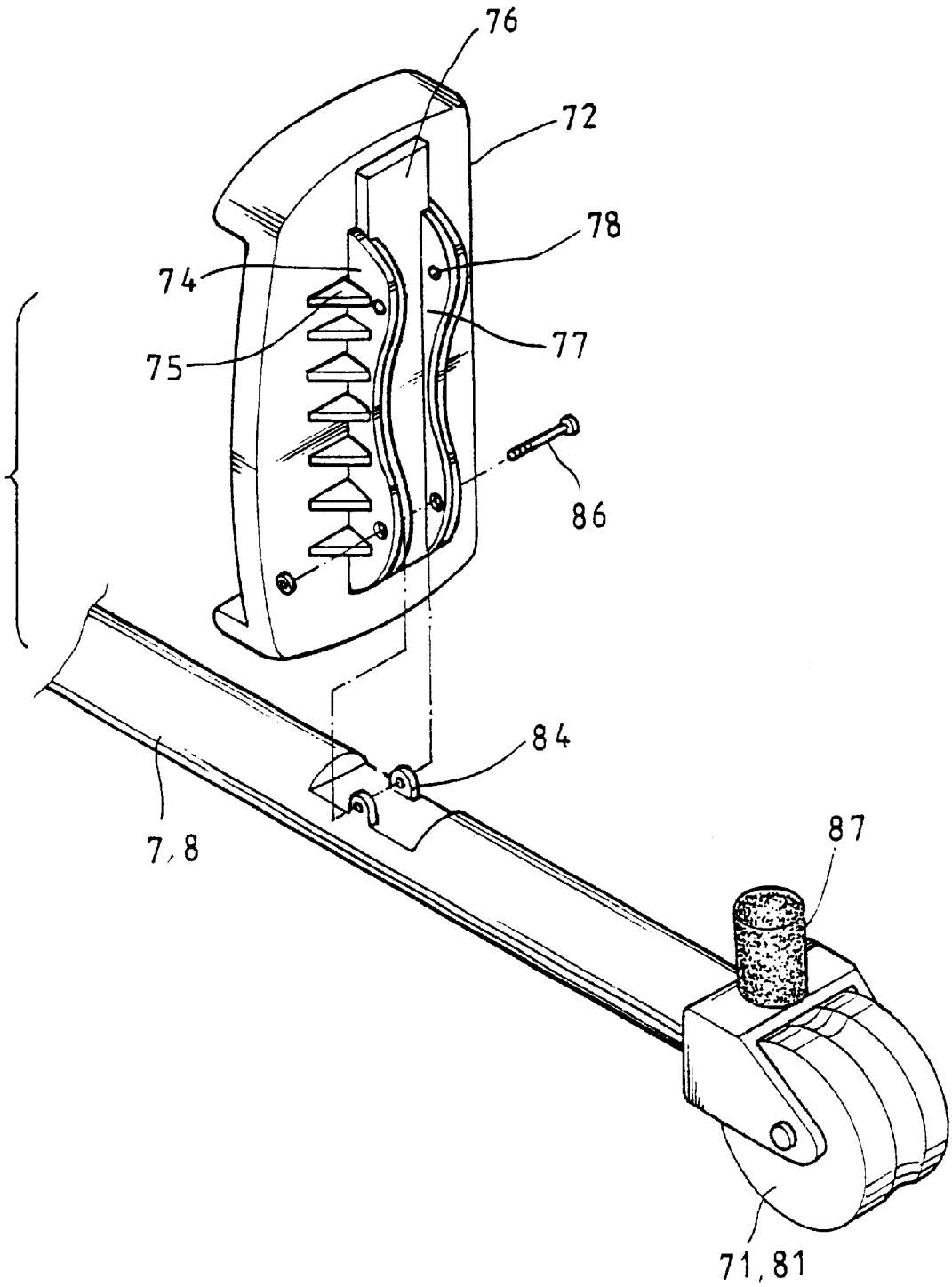
FIG. 6 is a partial exploded view showing the paddle device for the stepping exerciser.
Figure 7:
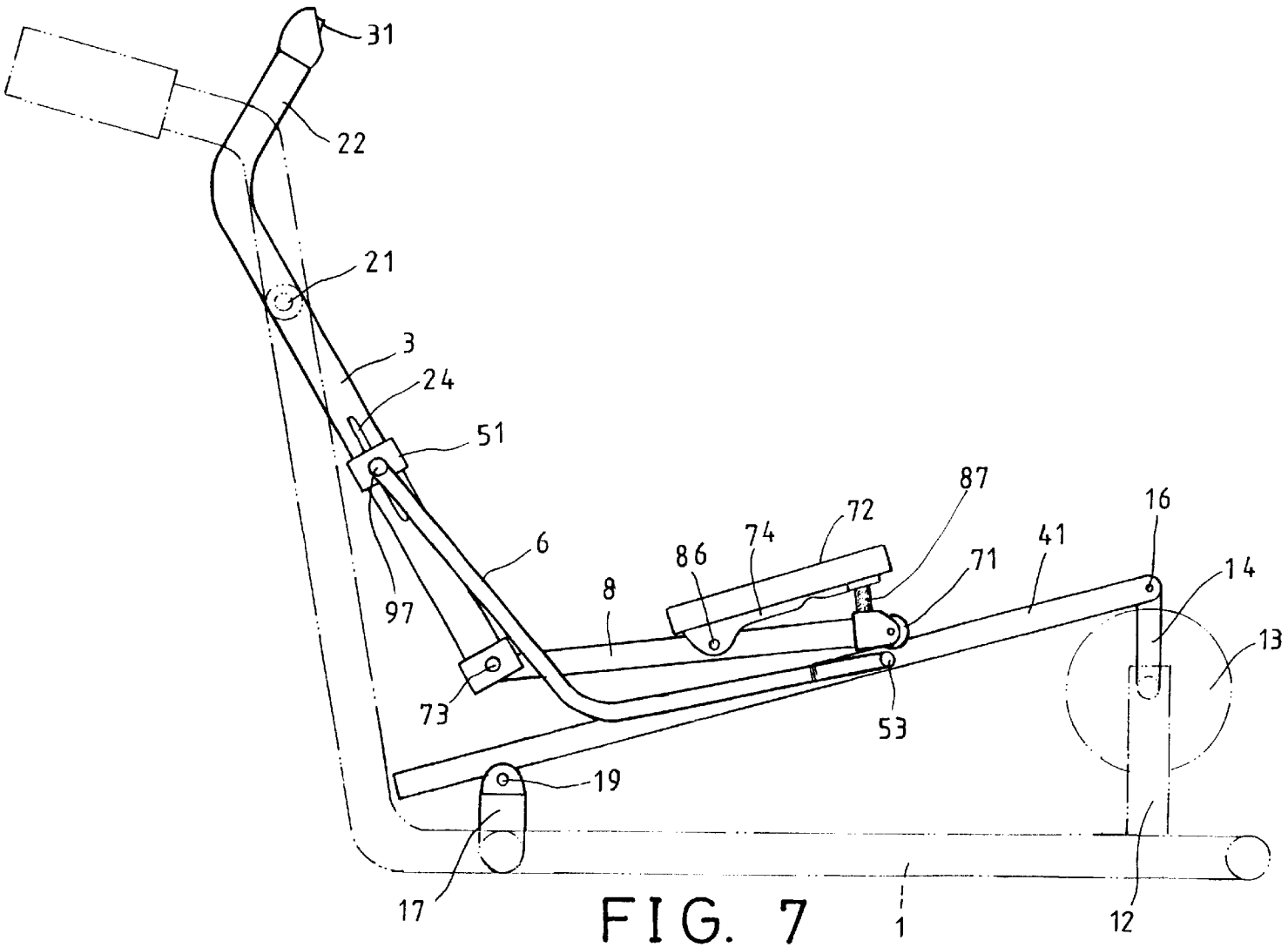
FIG. 7 is a side schematic view illustrating the operation of the exerciser.

As shown in FIGS. 2, 6, 7, the levers 7, 8 each includes a pair of ears 84 provided on the middle portion thereof, and each includes a cushioning pad 87 disposed on the rear portion thereof. The foot supports 72 each includes a front portion rotatably or pivotally secured to the respective levers 7, 8, with a pivot rod 86. For example, the foot supports 72 each includes a pair of walls 74 extended downward therefrom and reinforced by reinforcing ribs or ears 75 or the like. The pivot rod 86 is engaged through the walls 74 and the ears 84 for rotatably or pivotally securing the foot supports 72 to the respective levers 7, 8, A plate 76 is secured between the walls 74 of each of the foot supports 72, and includes a pair of panels 77 extended therefrom and secured to the walls 74 with fasteners 78 or by welding processes or the like. The foot supports 72 are made of plastic or rubber materials for comfortably supporting the users. The plates 76 are preferably made of metal materials, or plastic materials, or composite materials, or the other stronger materials for reinforcing the foot supports 72 and for engaging with the cushioning pads 87 respectively, for further comfortably supporting the users. As shown in FIGS. 2–4, the bars 2, 3 each includes a casing 27 secured therein. A bolt 90 is rotatably secured to each of the casings 27 and includes a gear 95 rotatably received in the casing 27. A motor 91 is secured in each of the bars 2, 3 and/or secured to the respective casings 27 and includes a pinion 92 extended therefrom or secured to the spindle thereof and preferably engaged in the casing 27. A reduction gearing device 93 is provided in the casing 27 and couples the pinion 92 of the motor 90 to the gear 95 of the bolt 90, such that the bolt 90 may be rotated by the motor 91 via the pinion 92 and the reduction gearing device 93 and the gear 95. A slide 96 is slidably received in each of the bars 2, 3 with rollers 98. A tube 94 is threaded with the bolt 90 and has one end pivotally secured to the slide 96, such that the slide 96 may be moved or adjusted along the respective bars 2, 3 by the motor 91 via the threading engagement between the bolt 90 and the tube 94. The slide 96 includes a pole 97 extended outward therefrom and slidably received in the respective slots 24 of the bars 2, 3.

A pair of sleeves 51 are slidably engaged on the respective bars 2, 3 and secured to the respective slides 96 with the poles 97 respectively, such that the sleeves 51 move in concert with the respective slides 96 and such that the sleeves 51 may be moved or adjusted along the respective bars 2, 3 by the motors 91. A pair of links 5, 6 each includes one end pivotally or rotatably secured to the respective tracks 41, 42 with a pivot pole 53 respectively, and each includes the other end pivotally or rotatably secured to the respective sleeves 51 with the pivot poles 97 or with the other pivots, such that the other ends of the links 5, 6 may be moved or adjusted along the respective bars 2, 3 together with the respective sleeves 51, by the motors 91. The foot supports 72 may thus also be adjusted relative to the bars 2, 3 in order to adjust the moving stride of the foot supports 72, when the sleeves 51 of the links 5, 6 are adjusted relative to the bars 2, 3.

A switch 31 is disposed on one of the bars 2, 3, such as disposed on top of the handle 22 of the bar 3, and may be coupled to the motor 91 and/or to the control box 10 for operating the motor 10 to adjust the the sleeves 51 of the links 5, 6, and thus to adjust the foot supports 72 relative to the bars 2, 3. For example, when the switch 31 is depressed once, the sleeves 51 may be moved upward along the bars 2, 3 respectively, by the motor 91. The sleeves 51 may be moved downward along the bars 2, 3 respectively when the switch 31 is depressed twice, and may not be moved relative to the bars 2, 3 when the switch 31 is depressed three times. One or more further switches 32 may further be provided and disposed on the bars 2, 3, such as disposed on the other bar 2 (FIGS. 1, 2) for adjusting the resistive force against the movement of the foot supports 72, for example.

In operation, as shown in FIGS. 1, 2 and 7, the foot supports 72 may be moved along an elliptical moving path or an elliptical stride when the bars 2, 3 are moved or rotated about the rod 21 and/or when the cranks 14 are rotated about the pivot shaft 131. The other ends of the links 5, 6 may be moved or adjusted along the respective bars 2, 3 by the motors 91 via the pinions 92, the reduction gearing mechanisms 93, the gears 95, the bolts 90, the tubes 94, the slides 96 and the sleeves 51, such that the elliptical moving path or the strides of the foot supports 72 may be adjusted. The wheel 13 may provide a resistive force against the movement of the foot supports 72.

It is to be noted that the motor 91 may still be actuated to adjust the the sleeves 51 of the links 5, 6, and thus to adjust the foot supports 72 relative to the bars 2, 3 while the bars 2, 3 are operated or are swung by the users, or while the exerciser is still operated or actuated. The switches 31, 32 may be operated or actuated by the hands of the users that hold the handles 22 without stopping the exercisers.

It is further to be noted that the front portions of the tracks 41, 42 are slidably supported on the pulleys 18 respectively. instead of being secured to the bars 2, 3, such that the foot supports 72 and the levers 7, 8 and thus the center of gravity or the moving path of the foot supports 72 may be lowered, because the front portions of the tracks 41, 42 will not be elevated by the bars 2, 3, and such that the stepping exerciser may be stably operated.

Accordingly, the stepping exerciser in accordance with the present invention includes an adjustable mechanism for easily and quickly adjusting the moving stroke or the moving path or the stride of the exerciser without stopping the exerciser, or while the exerciser is still operated; and includes a lowered moving path or a lowered center of gravity for allowing the stepping exerciser to be stably operated.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exerciser comprising:

a base including a front portion, and including a rear portion having a pair of cranks provided thereon, a pair of tracks including a rear end rotatably secured to said cranks respectively, and including a front portion slidably supported on said front portion of said base, a pair of bars pivotally secured to said front portion of said base, said bars each including a lower portion and a middle portion, a pair of levers movably supported on said base, and each including a foot support provided thereon, and each including a front portion pivotally secured to said lower portions of said bars, and each including a rear portion slidably engaged on said tracks respectively, for allowing said levers and said foot supports to be moved in a reciprocating action, and means for coupling said bars to said tracks, said tracks being movably supported on said front portion of said base without being elevated, for lowering said foot supports.

2. The exerciser according to claim 1, wherein said front portion of said base includes a pair of pulleys rotatably supported thereon for slidably supporting said front portions of said tracks respectively.

3. The exerciser according to claim 1, wherein said coupling means includes a pair of links having a rear end pivotally secured to said tracks respectively, and having a front portion pivotally coupled to said bars respectively.

4. The exerciser according to claim 3 further comprising means for adjusting said front portions of said links relative to said bars respectively in order to adjust said foot supports relative to said bars.

5. The exerciser according to claim 4, wherein adjusting means includes two sleeves slidably engaged on said bars respectively, said front portions of said links are pivotally secured to said sleeves respectively with a pivot pole.

6. The exerciser according to claim 4, wherein said adjusting means includes two slides slidably received in said bars respectively, said front portions of said links are pivotally secured to said slides respectively.

7. The exerciser according to claim 6 further comprising means for moving said slides relative to said bars respectively to adjust said links and said foot supports relative to said bars.

8. The exerciser according to claim 7, wherein said moving means includes a motor, means for connecting said motor to said slide to move said slides relative to said bars respectively.

9. The exerciser according to claim 8, wherein said moving means further includes a switch provided on top of said bars and coupled to said motor in order to actuate said motor without stopping said exerciser.

10. The exerciser according to claim 8, wherein said bars each includes a chamber formed therein for slidably receiving said slides respectively, said connecting means includes a pair of bolts rotatably received in said bars respectively and threadedly coupled to said slides respectively, and said motor is coupled to said bolts for rotating said bolts to move and to adjust said slided along said bars respectively.

11. The exerciser according to claim 10, wherein said slides each includes a tube coupled thereto and threadedly engaged with said bolts respectively, said connecting means includes a pinion attached to each of said motors, a gear attached to each of said bolts and coupled to said pinions respectively for coupling said motors to said bolts respectively.

12. The exerciser according to claim 1 further comprising means for cushioning said foot supports.

* * * * *